US006123407A

United States Patent [19]

Muraki

[11] Patent Number: 6,123,407

[45] Date of Patent: Sep. 26, 2000

[54] INK JET RECORDING APPARATUS

[75] Inventor: Motohito Muraki, Nagoya, Japan

[73] Assignee: Brother Kogyo Kabushiki Kaisha, Nagoya, Japan

[21] Appl. No.: 08/814,590

[22] Filed: Mar. 10, 1997

[30] Foreign Application Priority Data

Mar. 14, 1996 [JP] Japan ..... 8-087279

[51] Int. Cl.[7] ..... B41J 2/165

[52] U.S. Cl. ..... 347/24; 347/32; 347/29

[58] Field of Search ..... 347/24, 29, 30, 347/32, 33, 43

[56] References Cited

U.S. PATENT DOCUMENTS

| | | | |
|---|---|---|---|
| 5,182,582 | 1/1993 | Okamura | 347/33 |
| 5,381,168 | 1/1995 | Kondo et al. | 347/30 |
| 5,426,456 | 6/1995 | Kuelzer et al. | 347/30 |
| 5,448,271 | 9/1995 | Yamaguchi et al. | 347/30 |
| 5,625,385 | 4/1997 | Suzuki | 347/24 |
| 5,694,157 | 12/1997 | Ahlvin | 347/24 |

FOREIGN PATENT DOCUMENTS

| | | | |
|---|---|---|---|
| 0 630754 | 12/1994 | European Pat. Off. . | |
| 359078858 | 5/1984 | Japan | 347/24 |
| 402045156 | 2/1990 | Japan | 347/32 |
| 5-270006 | 10/1993 | Japan . | |
| 7-32599 | 2/1995 | Japan . | |

*Primary Examiner*—John Barlow
*Assistant Examiner*—Michael S. Brooke
*Attorney, Agent, or Firm*—Oliff & Berridge, PLC

[57] ABSTRACT

There are provided a purge cap 46 used both for a recovery and a protecting operations and protecting caps 21A–D used only for a protecting operation, in which the number of the protecting caps 21A–C is kept in three, less by one than the number of the ink jet heads. When the carriage is in the recovery area, the purge cap 46 alone is advanced to cover one of the ink jet heads, performing a recovery operation. When the carriage is in a protecting position, the purge cap 46 and the protecting caps 21A–C are obliquely advanced together, thereby covering all of the ink jet heads.

16 Claims, 12 Drawing Sheets

INK JET RECORDING APPARATUS

BACKGROUND OF THE INVENTION

1. Field of Invention

The present invention relates to an ink jet recording apparatus provided with plural ink jet heads, such as a multicolor printer, and more particularly to an ink jet recording apparatus provided with a compact sucking mechanism, which may be called a purging mechanism, for recovering an ejection state.

2. Description of Related Art

Recording apparatuses using an ink jet head generally need a mechanism for preventing deterioration in the ejecting state due to ink drying of the ink jet head, generation of air bubbles and the like, and for recovering the ink ejection state. Recording apparatuses are accordingly provided with a cap to cover a nozzle face of the ink jet head, which communicates with a suction pump. When recording is not performed, for example, to wait for transmission of recording data, the nozzle faces are covered and protected by the cap. In case of the ink ejection state deteriorating, a suction removal operation of ink is conducted by the suction pump to recover the defective ink ejection state.

Recently, ink jet recording apparatuses having plural ink jet heads have widely been used for color printing. Such an apparatus requires caps in a number corresponding to the number of ink jet heads in view of protecting the nozzle faces in a stand-by state. However, a recovery operation of the ink ejection by the suction pump is not always needed for all ink jet heads at the same time. If all caps are made to communicate with a common suction pump, therefore, the ink suction (purge) is executed even on the ink jet head in which the ink is not defective, resulting in a large waste of ink.

For example, Japanese patent application laid-open No. 5-27006 discloses an ink jet printer which is provided with caps for only a protecting operation, not communicating with the suction pump, in the same number as that of ink jet heads and, separately from those caps, a cap for only a purging operation, communicating with the suction pump. Specifically, the ink jet heads are covered respectively by the protecting caps in a stand-by state and only the ink jet head to be purged is covered by the purging cap. This makes it possible to avoid needless ink suction on the head for which the ink is not deteriorated.

In an ink jet recording apparatus disclosed in Japanese patent application laid-open No. 7-32599, there are provided caps in the same number as that of ink jet heads, in which a part of the caps is made to communicate with a suction pump so as to have a purging function.

However, the conventional ink jet recording apparatuses mentioned above have the following disadvantages.

The ink jet printer mentioned in the Japanese patent application laid-open No. 5-270006 is provided with caps in the number more than that of ink jet heads, needing a large space around the ink jet heads, thus resulting in an increase in size of the entire apparatus.

The ink jet recording apparatus in the Japanese patent application laid-open No. 7-32599, having no problem in size of the apparatus, unavoidably needs a driving motor only for advancing and retracting caps, separately from one for transporting a recording medium such as paper, causing a problem in cost and weight of the apparatus.

SUMMARY OF THE INVENTION

The present invention has been made in view of the above circumstances and has an object to overcome the above problems and to provide an ink jet recording apparatus provided with the same number of caps as ink jet heads, without a motor only for caps, capable of making the apparatus compact and preventing an increase in cost.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an ink jet recording apparatus of the present invention, comprising plural ink jet heads for performing recording by ejecting ink from nozzles on a recording medium, a carriage on which the ink jet heads are mounted, rendered movable as facing the recording medium, and a sucking mechanism for recovering an ink ejection state by sucking ink from the inside of the ink jet heads, the apparatus comprising a cap for covering a nozzle face of the ink jet head, connected with the sucking mechanism, used for both protecting and sucking operations, caps for respectively covering nozzle faces of the ink jet heads except one covered by the protecting and sucking cap, used only for a protecting operation, means for advancing the protecting caps toward the ink jet head when the carriage is moved to a protecting position, thereby covering the nozzle faces of the ink jet heads except the one, and means for advancing the protecting and sucking cap interlockingly with the advancing motion of the protecting caps, thereby covering the ink jet head not covered with the protecting caps.

According to the present invention, there is also provided an ink jet recording apparatus further comprising means for transporting the recording medium, and a transporting motor for driving the transporting means, wherein the transporting motor is separated from the transporting means when the carriage is moved to a sucking position and alternatively is connected to the sucking mechanism.

According to the present invention, there is also provided an ink jet recording apparatus further comprising a first return spring for biasing the protecting caps in a retracting direction, and a second return spring for biasing the protecting and sucking cap in a retracting direction.

According to the present invention, there is also provided an ink jet recording apparatus further comprising means for advancing and retracting the protecting and sucking cap by driving of the transporting motor when the carriage is at a sucking position.

According to the present invention, there is also provided an ink jet recording apparatus further comprising a wiper member for wiping the ink jet heads, and means for advancing and retracting the wiper member in relation to the advancing and retracting movement of the protecting and sucking cap.

According to the present invention, there is also provided an ink jet recording apparatus further comprising means for preventing driving of the transporting motor when the carriage is at a protecting position.

In the ink jet recording apparatus of the present invention, the carriage is moved as facing a recording medium in a normal recording state and the ink jet head mounted on the carriage ejects ink from the nozzles, effecting print recording on the recording medium. In a stand-by state to wait for a recording command, the carriage is moved at a protecting position, when the protecting caps are advanced by the advancing means. The protecting and sucking cap is also advanced by the interlocking means at the same time. Accordingly, the nozzle faces of the ink jet heads, except one head, are covered by the caps used only for a protecting operation, and the remaining one head is covered by the cap used for both protecting and sucking operations, so that all of the nozzle faces of the ink jet heads are covered, thereby preventing causes of ink ejection deterioration resulted from ink drying and the like in the ink jet heads. At this time, the ink jet head covered by the protecting and sucking cap can be subjected to a recovery operation to recover the ink ejection state by sucking the ink in the head by the sucking mechanism.

According to the present invention, the nozzle faces of the ink jet heads are covered by the protecting cap advanced when the carriage is moved to the protecting position and the protecting and sucking cap advanced together with the protecting cap, so that the number of caps can be kept in the same number of the ink jet head, and no motor used only for moving the caps is needed, realizing a light and compact ink jet recording apparatus.

In the ink jet recording apparatus of the present invention, the transporting motor is connected to the transporting means in a normal recording state, thereby achieving recording while transporting the recording medium by the driving of the transporting motor. In this state, the transporting motor is not connected to the sucking mechanism, so that even if the transporting motor is activated for transporting the recording medium, the sucking mechanism is not driven. When the carriage is moved to a sucking position, however, the transporting motor is separated from the transporting means and alternatively connected to the sucking mechanism, enabling suction of ink from the ink jet head by the sucking mechanism.

In the ink jet recording apparatus according to the present invention, the operation of advancing means is released as the carriage leaves the protecting position, when the protecting caps are retracted by a biasing force of the first return spring. Simultaneously, the protecting and sucking cap is also retracted by a biasing force of the second return spring. Thus, all of the ink jet heads are released from the caps.

In the ink jet recording apparatus according to the present invention, when the carriage is at the sucking position, driving of the transporting motor causes the cap advancing and retracting means to advance and retract the protecting and sucking cap. Accordingly, separately from the movement of the protecting caps, only the protecting and sucking cap can be advanced to cover any one of the ink jet heads. In this state, the transporting motor is connected to the suction mechanism, thereby enabling the ink sucking operation on the ink jet head by the sucking mechanism.

In the ink jet recording apparatus according to the present invention, furthermore, when the wiper member is advanced by the wiper moving means, the nozzle faces of the ink jet heads are wiped by the wiper member in the course of the carriage being moved from the sucking position to a position opposite to the recording medium, thereby removing surplus ink from the nozzle faces. When the wiper member is retracted and thus is not in contact with the nozzle faces, the movement of the carriage from the position opposite to the recording medium to the sucking position can be performed smoothly.

In the ink jet recording apparatus according to the present invention, when the carriage is at the protecting position, the preventing means forbids driving of the transporting motor. In this state, both the recording medium and the sucking mechanism are not driven.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF PREFERRED EMBODIMENTS

A detailed description of one preferred embodiment of an ink jet recording apparatus embodying the present invention will now be given referring to the accompanying drawings.

Figure 1:
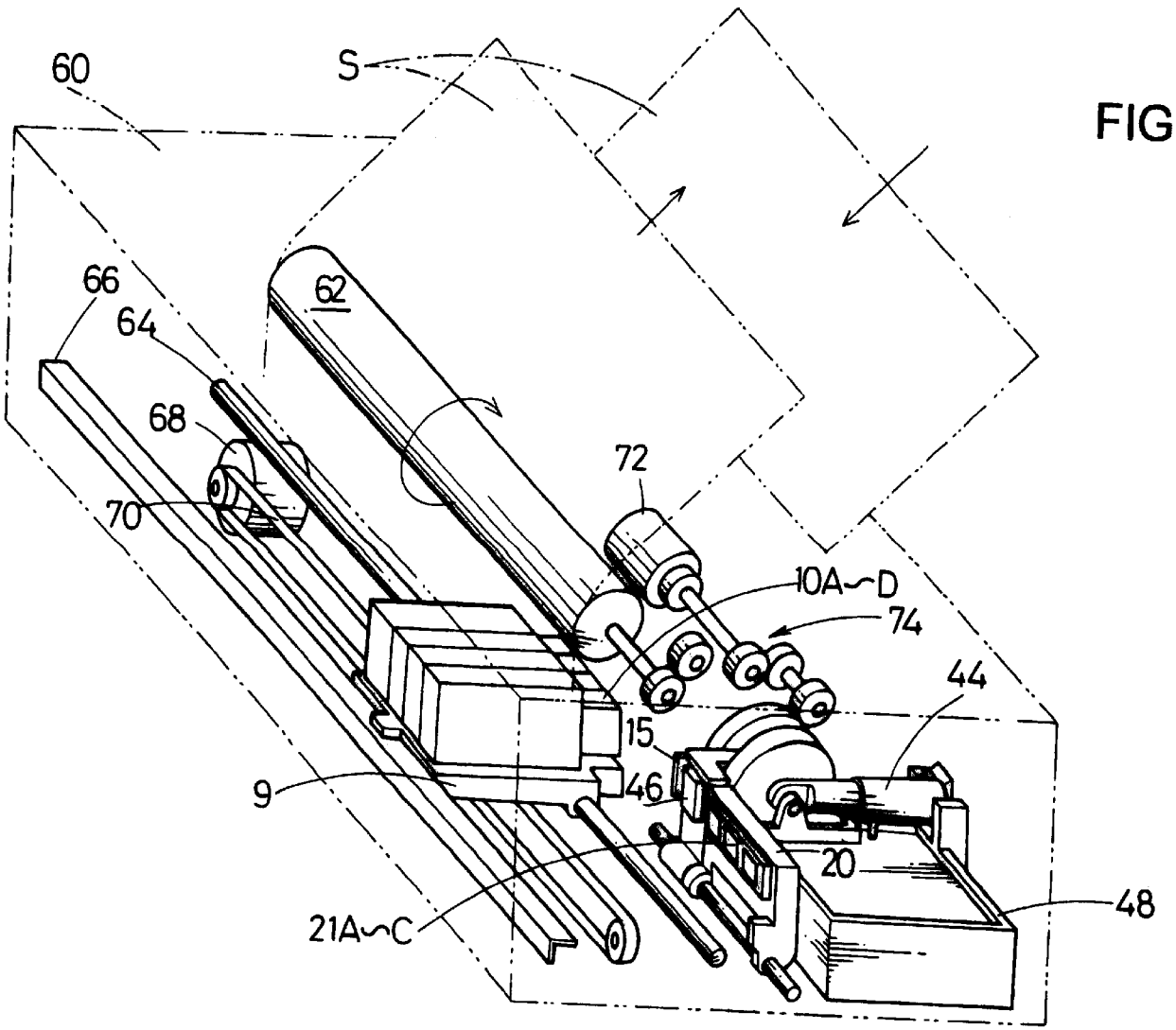
FIG. 1 is a schematic view of the ink jet recording apparatus in the embodiment.

The ink jet recording apparatus according to the embodiment has a schematic structure shown in FIG. 1.

As shown in FIG. 1, in a casing 60 of the ink jet recording apparatus, there is provided a cylindrical platen roller 62 for transporting a recording sheet S, rotatably about an axis thereof. A guide rod 64 and a guide rail 66 are disposed in parallel with the platen roller 62, and a carriage 9 is supported by the guide rod 64 and the guide rail 66 so as to be movable parallel to the platen roller 62. The carriage 9 is made to drive through a belt 70 by a CR motor 68 mounted at a lower part in the casing 60. A linear encoder is disposed in the vicinity of the belt 70, whereby the position of the carriage 9 can be monitored. The movable area of the carriage 9 includes a recording area for a recording operation, a recovery area for a recovery operation, and a stand-by position to wait for a recording command. The recovery area exists between the recording area and the stand-by position.

On the carriage 9 are mounted four ink jet heads 10A–D for full-color printing, respectively having a color ink; black, cyan, magenta. Each of ink jet heads 10A–D has plural nozzles on a side opposite to the platen roller 62, for ejecting ink on the recording sheet S arranged on the platen roller 62, thereby performing print recording.

For a recovery system for recovering an ink ejection state of the ink jet heads 10A–D when the ink has deteriorated, in the casing 60 there are provided a wiper 15, a purge pump 44 and a purge cap 46. At the side of the purge cap 46 are provided protecting caps 21A–C for protecting the nozzle faces of the ink jet heads 10A–D in a stand-by state. The number of the protecting caps 21A–C is three in the embodiment, corresponding to the number of ink jet heads except one for the purge cap 46. Behind the protecting caps 21A–C, arranged is a drain tank 48 for storing discharged ink emitted from the purge pump 44.

There is also provided in the casing 60 a PF motor 72 for selectively driving either the platen roller 62 or the recovery system including the purge pump 44 and the like. The rotation of the PF motor 72 is transmitted through a gear train 74 to either the platen roller 62 or the recovery system. Such a switching operation of the gear train 74 is effected by a well known kicker mechanism in accordance with the motion of the carriage 9. In detail, the switching operation is performed in a part between the recording area and the recovery area, and the gear train 74 is linked with the platen roller 62 in the recording area and with the recovery system in the recovery area (and the stand-by position).

Here, as broadly known, the kicker mechanism has a rotatable change lever. One end thereof is engageable with the back side portion (which is positioned at the side of the ink jet head 10A–D) when the carriage 9 moves from the recording range into the recovering range and vice versa. And on the other end of the change lever, a swing gear is rotatably supported. This swing gear is selectively meshed with the gear train 74 so that the PF motor 72 is connected to the platen roller 62 or the recovery system through the gear train 74. Concretely, when the carriage 9 exists in the recording range, the PF motor 72 is connected to the platen roller 62 through the gear train 74 based on the changing operation by the kicker mechanism (a first drive mode). On the other hand, when the carriage 9 exists in the recovering range, the PF motor 72 is connected to the recovery system through the gear train 74 based on the changing operation by the kicker mechanism (a second drive mode). At this point, the kicker mechanism acts as the changing mechanism for selectively transmitting the drive force of the PF motor 72 to one of the platen roller 62 and the recovery system, i.e., for selectively changing drive modes with the PF motor 72 between the first drive mode and the second drive mode.

Figure 2:
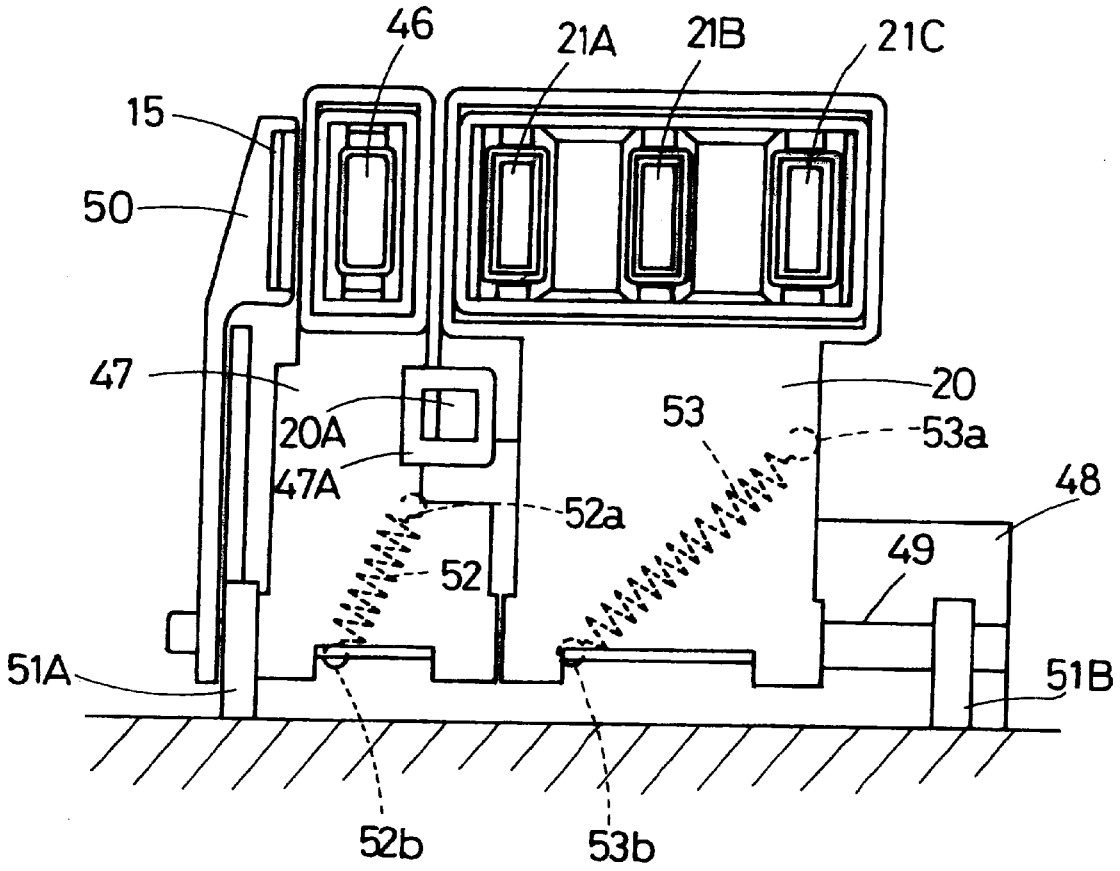
FIG. 2 is a front view of a purge cap and protecting caps.

The recovery system constructing a main part of the ink jet recording apparatus will further be explained. As shown in FIG. 2, the purge cap 46 held in a purge cap holder 47, the protecting caps 21A–C held in a protecting cap case 20, and the wiper 15 fixed in a wiper arm 50, are arranged side by side. In the vicinity of the bottom of the casing 60, a cap supporting shaft 49 is provided supported by bearings 51A and 51B at both end portions. The wiper arm 50, the purge cap holder 47, and the protecting cap case 20 are respectively mounted in this order on the cap supporting shaft 49 so as to be rotatable about the shaft 49. This makes it possible to advance or retract the purge cap 46, the protecting cap 21A–C, and the wiper 15 respectively toward and away from the nozzle faces of the ink jet heads 10A–D.

The wiper arm 50 is mounted at a position outside of the bearing 51A, closer to the platen roller 62 side, so as to be rotatable about the supporting shaft 49 but not to move in the axis direction. The purge cap holder 47 and the protecting cap case 20 are mounted so as to be rotatable about the cap supporting shaft 49 and also slidable in the axis direction between the bearings 51A and 51B. The purge cap holder 47 is provided with a circular hook 47A at almost the center, namely, a position below a holding portion for the purge cap 46 and closer to the protecting cap case 20. This hook 47A is formed so as to protrude forward, namely, toward the carriage 9, resulting in the contact with the carriage 9 moving from the recovery area to the stand-by position. On the other hand, the protecting cap case 20 is provided with a hooker 20A in a projecting form at almost the center, namely a position below a holding portion for the protecting caps 21A–C and closer to the purge cap holder 47. This hooker 20A is fitted in the hook 47A from the back thereof, thereby interlocking the purge cap holder 47 and the protecting cap case 20.

This interlocking causes the following three limitations in the movement of the purge cap holder 47 and the protecting cap case 20.

1) The purge cap holder 47 and the protecting cap case 20 can be moved in the axis direction of the supporting shaft 49 only as contacted with each other, not allowing them to separate from each other.

2) When the purge cap holder 47 is rotated about the supporting shaft 49 to retract from the nozzle faces of the ink jet heads 10A–D, the protecting cap case 20 is retracted together.

3) When the protecting cap case 20 is advanced toward the nozzle faces, the purge cap holder 47 is simultaneously advanced due to the interlocking by the hook 47A and the hooker 20A.

Incidentally, although it is possible to allow the purge cap holder 47 to advance while the protecting cap case 20 to retract, the hook 47A and the hooker 20A are formed so that the interlocking therebetween cannot be released even in that state.

Return springs 52 and 53 are provided at the back of the purge cap holder 47 and the protecting cap case 20 respectively. Upper ends 52*a* and 53*a* of the return springs 52 and 53 are respectively fixed on the back of the purge cap holder 47 and the protecting cap case 20, and lower ends 52*b* and 53*b* are fixed on the casing 60. Accordingly, with regard to the movement about the supporting shaft 49, the purge cap holder 47 and the protecting cap case 20 are biased by the return springs 52 and 53 in a direction retracting from the nozzle faces of the ink jet heads 10A–D. In addition, the fixing positions of the lower ends 52*b* and 53*b* are set closer to the platen roller 62 side as shown in FIG. 2 than those of the upper ends 52*a* and 53*a*, so that, in the axis direction of the supporting shaft 49, the purge cap holder 47 and the protecting cap case 20 are biased toward the platen roller 62 side.

Figure 3:
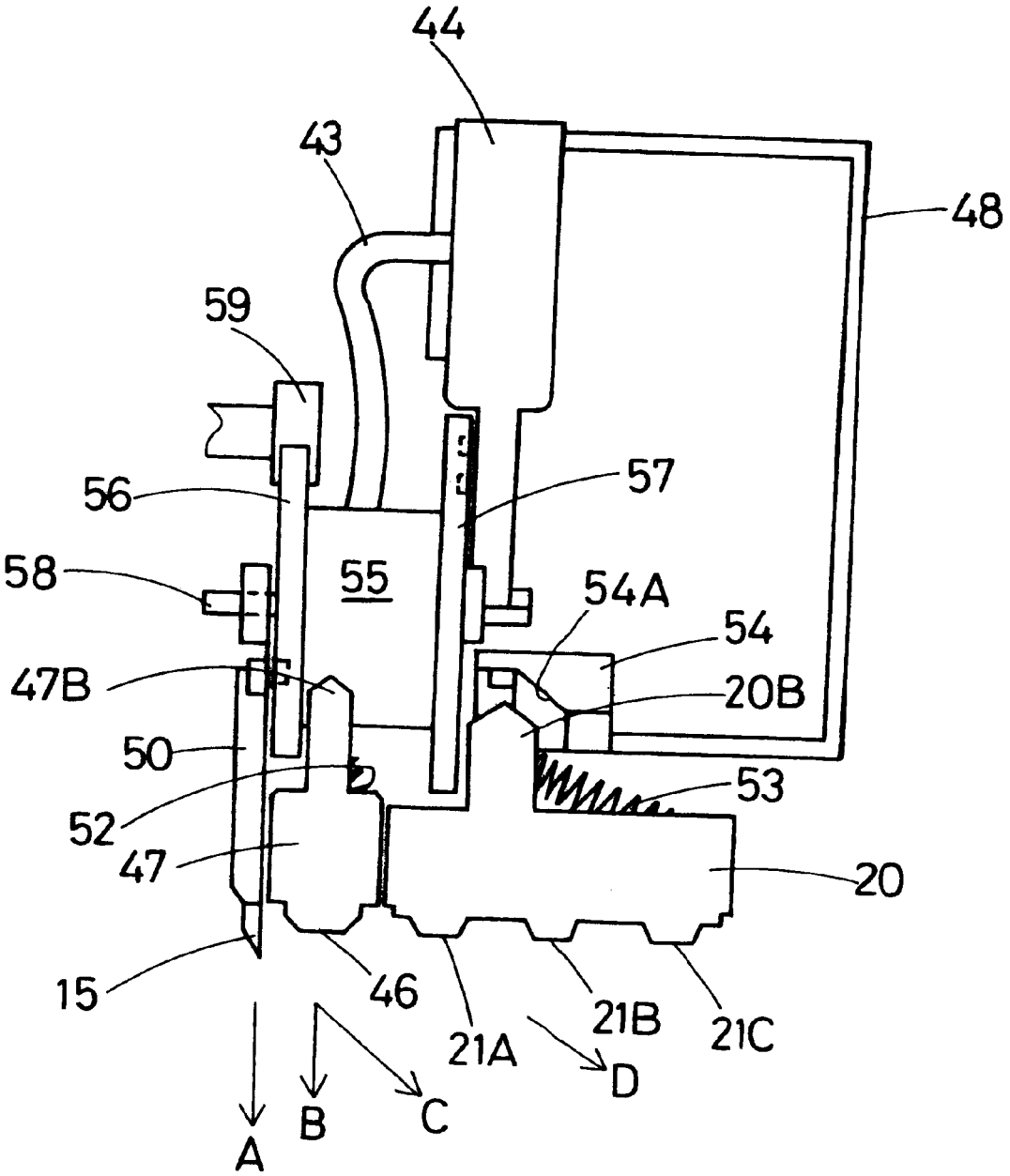
FIG. 3 is a plane view of a purge cap holder, a protecting cap case, and a recovery system.

The recovery system will further be explained with reference to FIG. 3 showing a plane view of the recovery system. At the back of the protecting cap case 20 is attached a guide plate 54, in which a back end 20B of the protecting cap case 20 is pushed against the guide plate 54 by a biasing force of the return spring 53. The guide plate 54 is formed having an inclination surface 54A. When moved in a direction away from the platen roller 62 (in a right direction in FIG. 3), accordingly, the protecting cap case 20 is pushed along the inclination and advanced against the biasing force of the return spring 53. A state where the protecting cap case 20 pushed forward is shown in a crosssectional view of FIG.

4. In this state, the protecting caps 21A–21C cover three nozzle faces among the ink jet heads 10A–D, the remaining one also being covered by the purge cap 46. A state where the protecting cap case 20 retracted is shown in a cross-sectional view of FIG. 5. In this state, the protecting caps 21A–C are retracted with the protecting cap case 20, thereby producing a space between the protecting caps 21A–C and the ink jet heads 10A–D.

At the back of the purge cap holder 47 is disposed a cap cam 55 having a non-circular cross-section. A back end 47B of the purge cap holder 47 is pushed against the cap cam 55 by a biasing force of the return spring 52. On both sides of the cap cam 55, a wiper cam 56 and a pump cam 57 in the form of disc are provided integrally with the cap cam 55. These cams 55, 56 and 57 are made rotatable about a cam shaft 58 parallel to the platen roller 62. The cap cam 55 having a non-circular cross-section, the purge cap holder 47 is pushed forward against the biasing force of the return spring 52 according to the rotating angle of the cam shaft 58.

Figure 6:
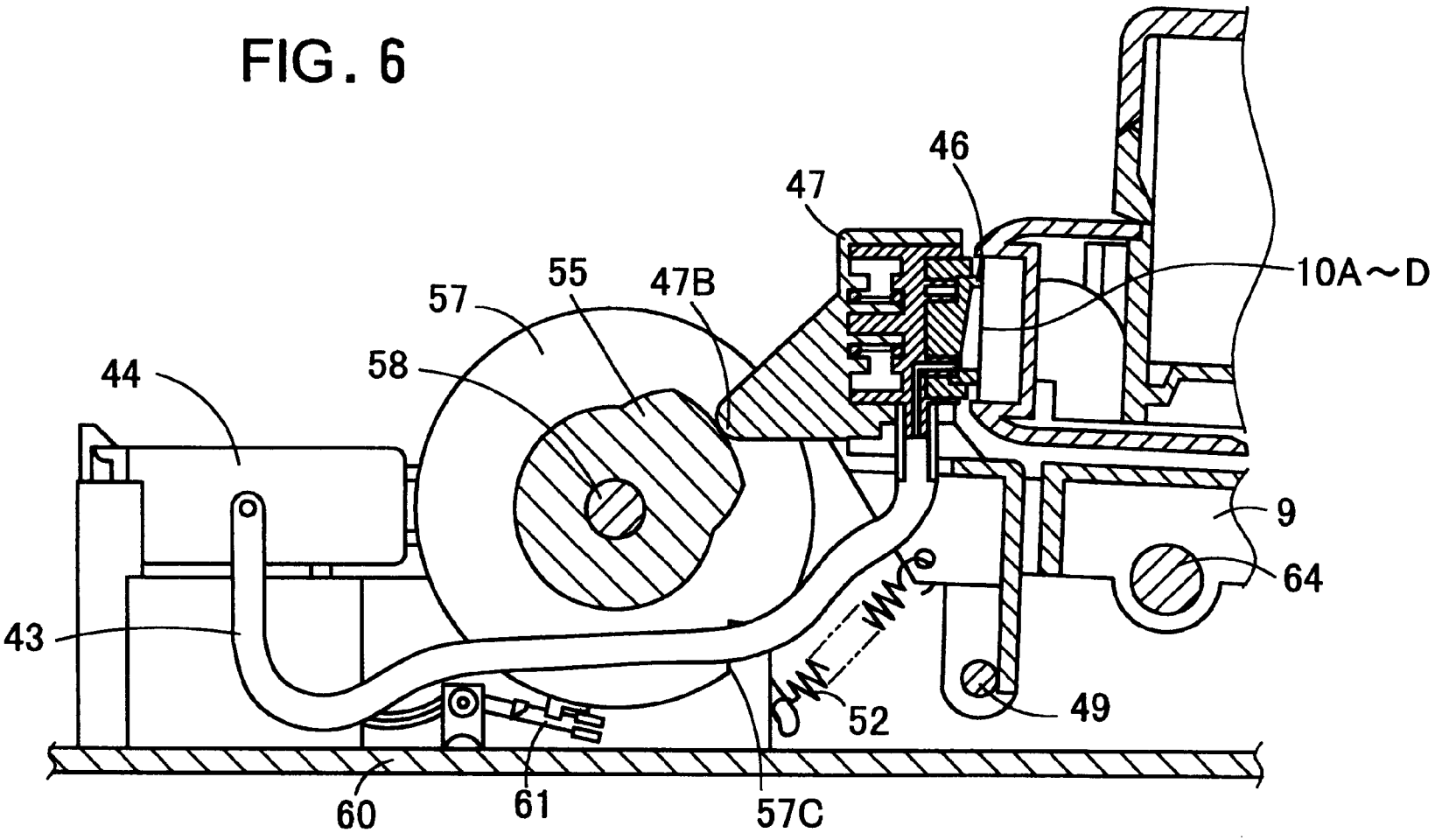
FIG. 6 is a cross sectional view seen from the side showing a state where the purge cap advanced covers the nozzle faces.
Figure 7:
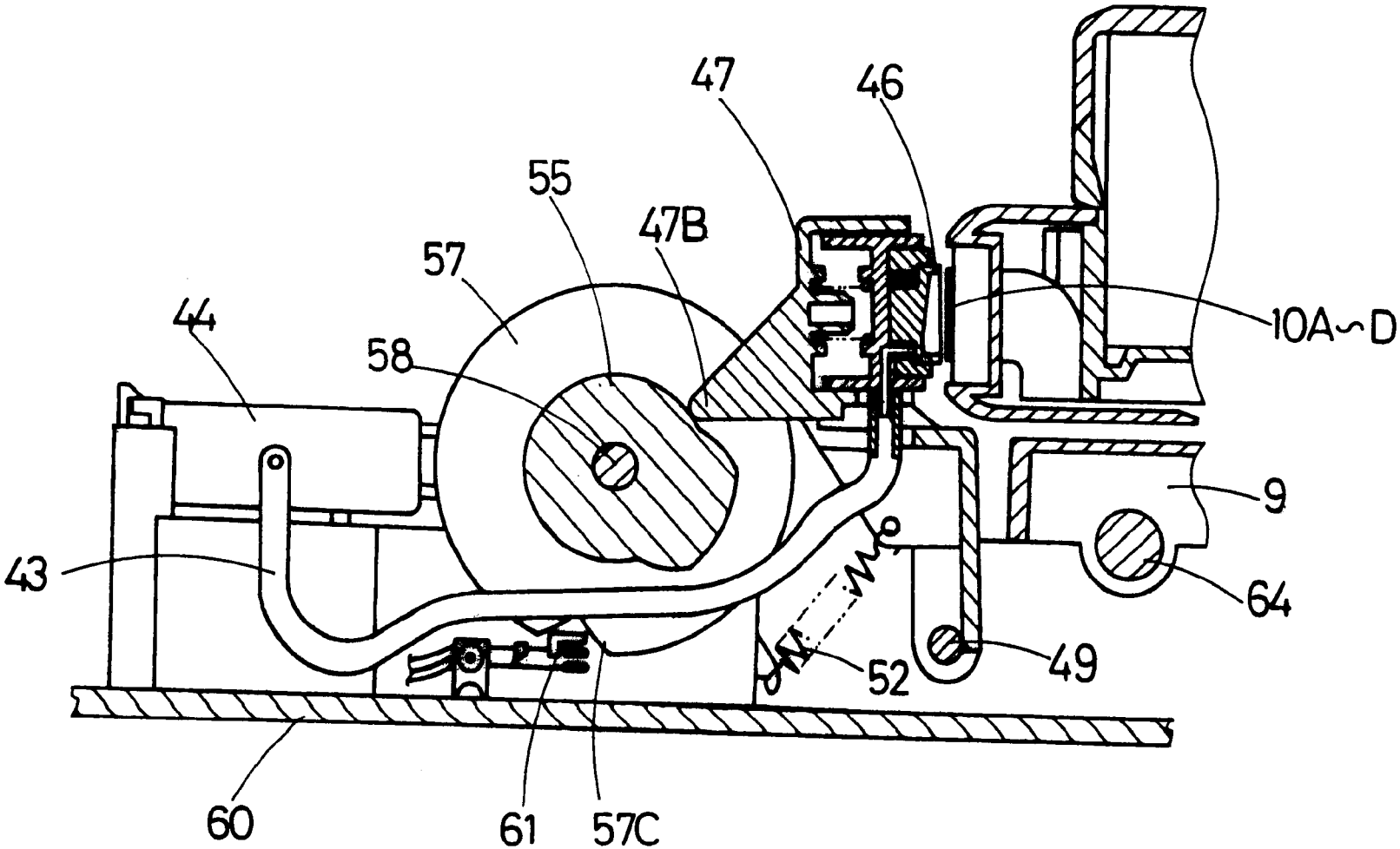
FIG. 7 is a cross sectional view seen from the side showing a state where the purge cap is retracted, having a space between the purge cap and the nozzle faces.

A state where the purge cap holder 47 is pushed forward due to the rotating angle of the cap cam 55 is shown in FIG. 6. In this state, the purge cap 46 advanced covers one of nozzle faces of the ink jet heads 10A–D. A state where the purge cap holder 47 is retracted depending on the rotating angle of the cap cam 55 is shown in FIG. 7, in which there is a space between the purge cap 46 retracted and the ink jet heads 10A–D.

In order to make it possible to cover any of the ink jet heads 10A–D by the purge cap 46, the recovery area where the carriage 9 can be positioned for a recovery operation includes a width from the ink jet head 10A to 10D.

The wiper cam 56 is provided, at its surface closer to the platen roller 62 side, with a cam groove 56A (see FIGS. 8 and 9) for advancing and retracting the wiper arm 50 toward and from the ink jet head and, at its periphery, teeth to be engaged with a cam gear 59 constructing a part of the gear train 74. Accordingly, the wiper cam 56 has a function to transmit a driving force from the PF motor 72 through the gear train 74 to the entire recovery system, and another function to advance and retract the wiper 15. A state where the wiper arm 50 is advanced by the wiper cam 56 is shown in a side view of FIG. 8. In this state, the nozzle faces of the ink jet heads 10A–D are wiped as the wiper 15 advances. A state where the wiper arm 50 is retracted by the wiper cam 56 is shown in FIG. 9. In this state, the carriage 9 can be moved smoothly because the wiper 15 is positioned away from the nozzle faces.

Figure 4:
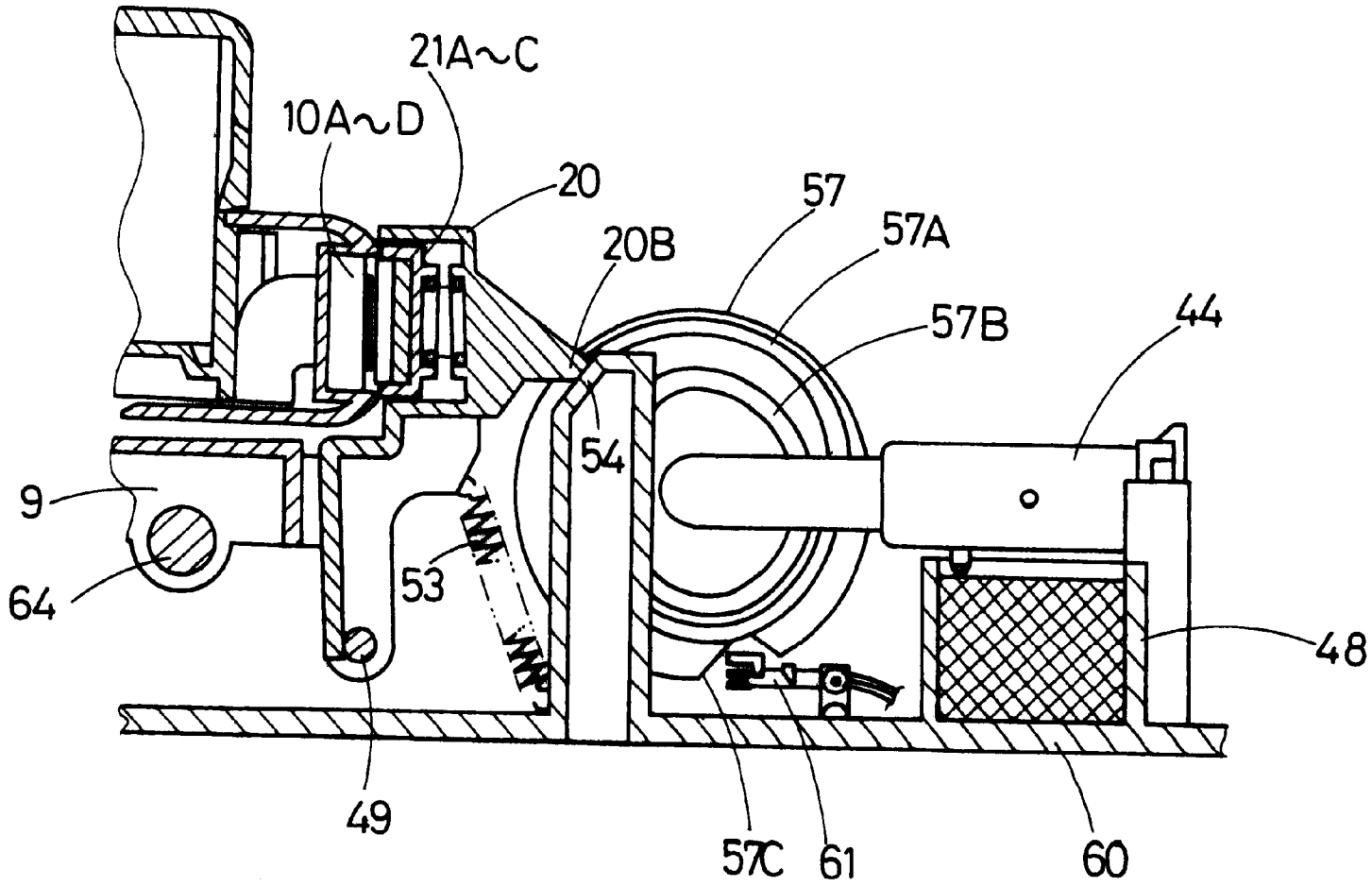
FIG. 4 is a cross sectional view seen from the side showing a state where the protecting cap advanced covers the nozzle faces.

The pump cam 57 is provided, at its surface closer to the drain tank 48, with two cam grooves 57A and 57B (see FIGS. 4 and 5) for driving the purge pump 44. A cutout 57C is formed in the periphery of the pump cam 57, thereby activating a sensor 61 installed in the casing 60 to inform a control system (described later) that the purge pump 44 is in an initial position. The purge pump 44 is in communication with the purge cap holder 47 through a hose 43 as shown in FIGS. 6 and 7.

The cap cam 55, the wiper cam 56 and the pump cam 57 being rotatable integrally with the cam shaft 58, the movement of the purge cap 46 and the wiper 15 and the activation of the purge pump 44 are mutually linked. More specifically, the suction by the purge pump 44 is conducted when the purge cap 46 is positioned at an advanced position, and advancing of the wiper 15 is conducted synchronously with retracting of the purge cap 46.

Figure 13:
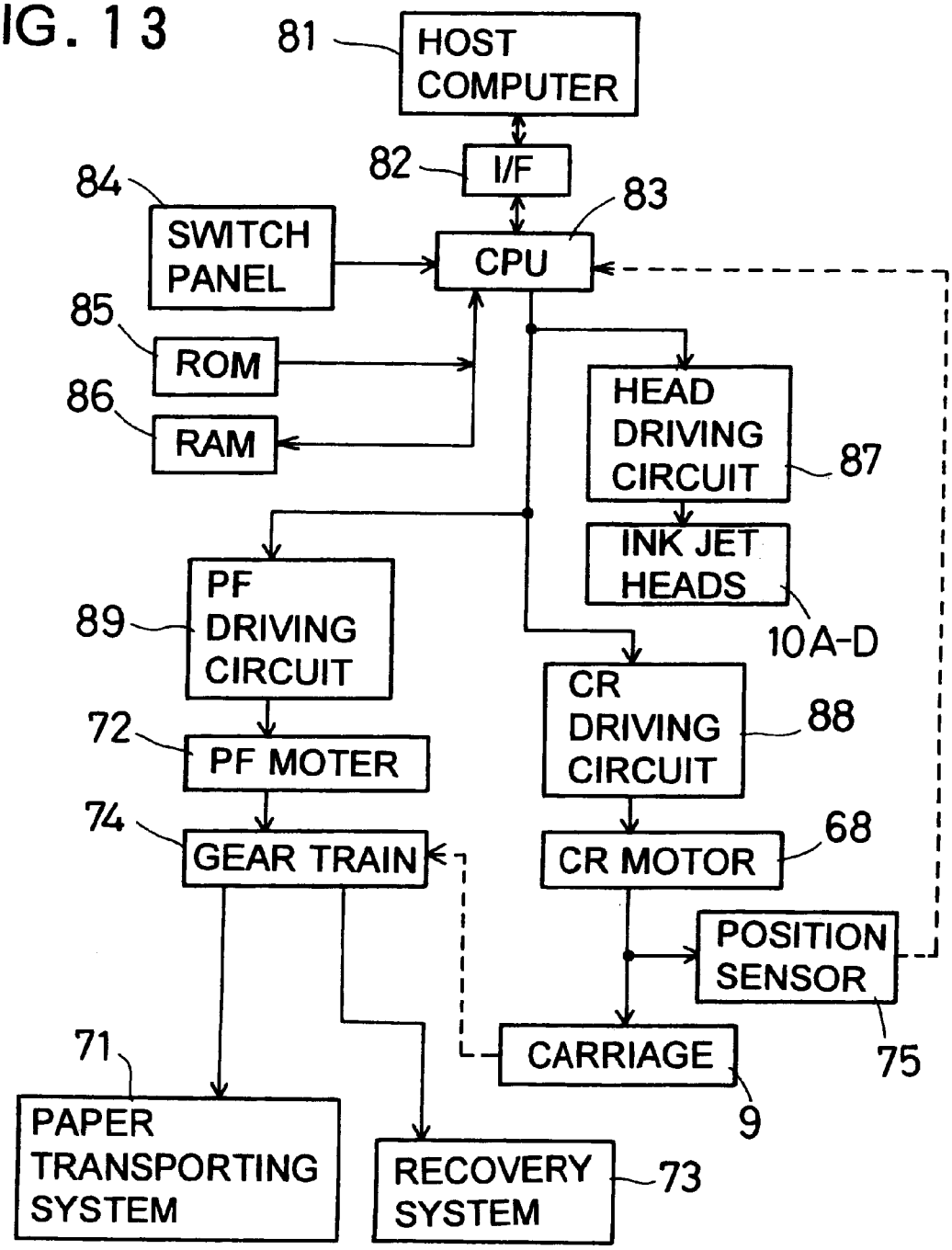
FIG. 13 is a block diagram of a control system of the ink jet recording apparatus in the embodiment.

Next, a control system of the ink jet recording apparatus will be described with reference to FIG. 13.

This control system has a CPU 83 which is a well known processing unit, connected through an interface 82 to a host computer (personal computers and the like). When it receives a recording command from the host computer 81, the ink jet recording apparatus carries out various recording in accordance with the record command. The CPU 83 is also connected with a switch panel 84 for setting various recording parameters such as a sheet size and others, a ROM 85 for storing various programs necessary for controlling the ink jet recording apparatus, and a RAM 86 for provisionally memorizing recording data transmitted from the host computer 81 and various values necessary for controlling the ink jet recording apparatus.

To CPU 83, there are also connected a head driving circuit 87 for driving the ink jet heads 10A–D, a CR driving circuit 88 for driving the CR motor 68, and a PF driving circuit 89 for driving the PF motor 72. The CR motor 68 is driven to move the carriage 9 through the belt 70 as described above. A linear encoder disposed in the vicinity of the belt 70 serves as a position sensor 75 to transmit a signal representing the position of the carriage 9 to the CPU 83. In receiving the position signal, the CPU 83 controls the PF motor 72 not to drive when the carriage 9 is positioned at a stand-by position. The PF motor 72 drives, thorough the gear train 74, selectively either a paper transporting system 71 constructed of the platen roller 62 and others or a recovery system 73 constructed of the purge pump 44 and others. The selection of a system to be driven by the gear train 74 is effected by a well known kicker mechanism based on the movement of the carriage 9 as mentioned above.

The operation of the ink jet recording apparatus is described as follows. The basic operation of the ink jet recording apparatus is to perform recording on a recording sheet S arranged on the platen roller 62 by ejecting ink from the ink jet heads 10A–D.

Figure 5:
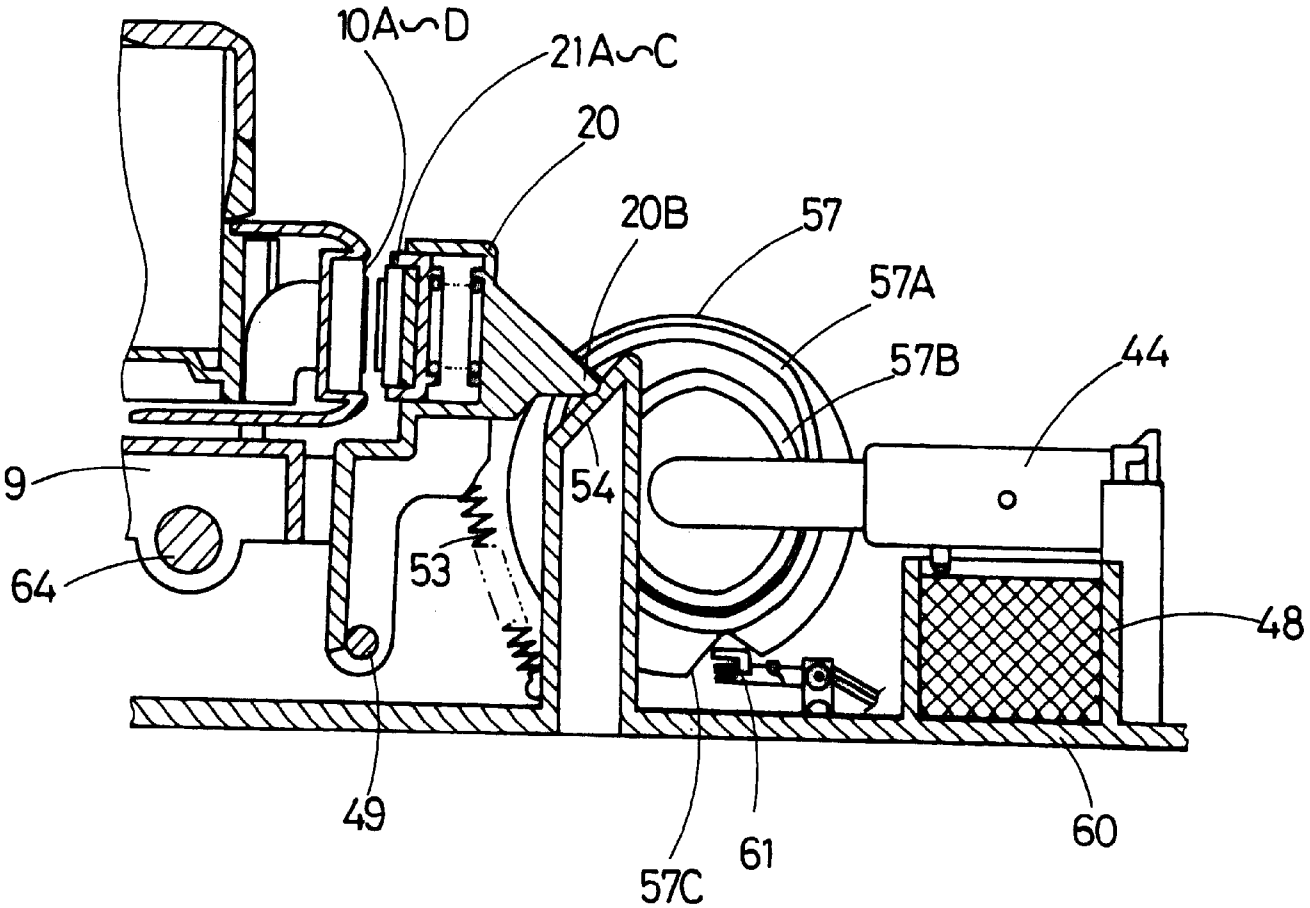
FIG. 5 is a cross sectional view seen from the side showing a state where the protecting caps are retracted, having a space between the protecting caps and the nozzle faces.

Specifically, the rotation of the platen roller 62 transports the recording sheet S until a part to be recorded comes into opposition with the ink jet heads 10A–D. While the carriage 9 is moved within the recording area by the CR motor 68, the ink jet heads 10A–D are driven to eject ink on the sheet S, thereby achieving recording. After completion of recording in one line, the recording sheet S is advanced by a line by the platen roller 62. A recording operation in that line is similarly conducted. This subsequent operation is controlled by the CPU 83 in accordance with commands from the host computer 81. In a recording operation, the protecting caps 21A–C, the purge cap 46, and the wiper 15 are respectively in retracted positions as shown in FIGS. 5, 7, and 9.

In such a recording operation, there are instances where inferior ink ejection results from deterioration of the ink, such as generation of air bubbles in the ink jet heads 10A–D, an increase in the viscosity of the ink resulting from the ink drying, and foreign substance, such as pieces of paper and the like in the ink. To prevent such inferior ink ejection, a recovery operation on the ink jet heads 10A–D is conducted regularly or when necessary. This recovery operation is achieved by covering the head to be recovered among the ink jet heads 10A–D by the purge cap 46 and suctioning the ink therefrom by the purge pump 44. To perform the recovery operation, first, a recording operation is stopped and the carriage 9 is moved from the recording area to the recovery area. At this time, the kick motion caused by movement of the carriage 9 causes the gear train 74 to switch, thereby separating the PF motor 72 from the platen roller 62 and connecting the same to the recovery system. The carriage 9 is stopped at a position where the head on which a recovery operation is to be exerted among the ink jet heads 10A–D comes into opposition with the purge cap 46.

Figure 10:
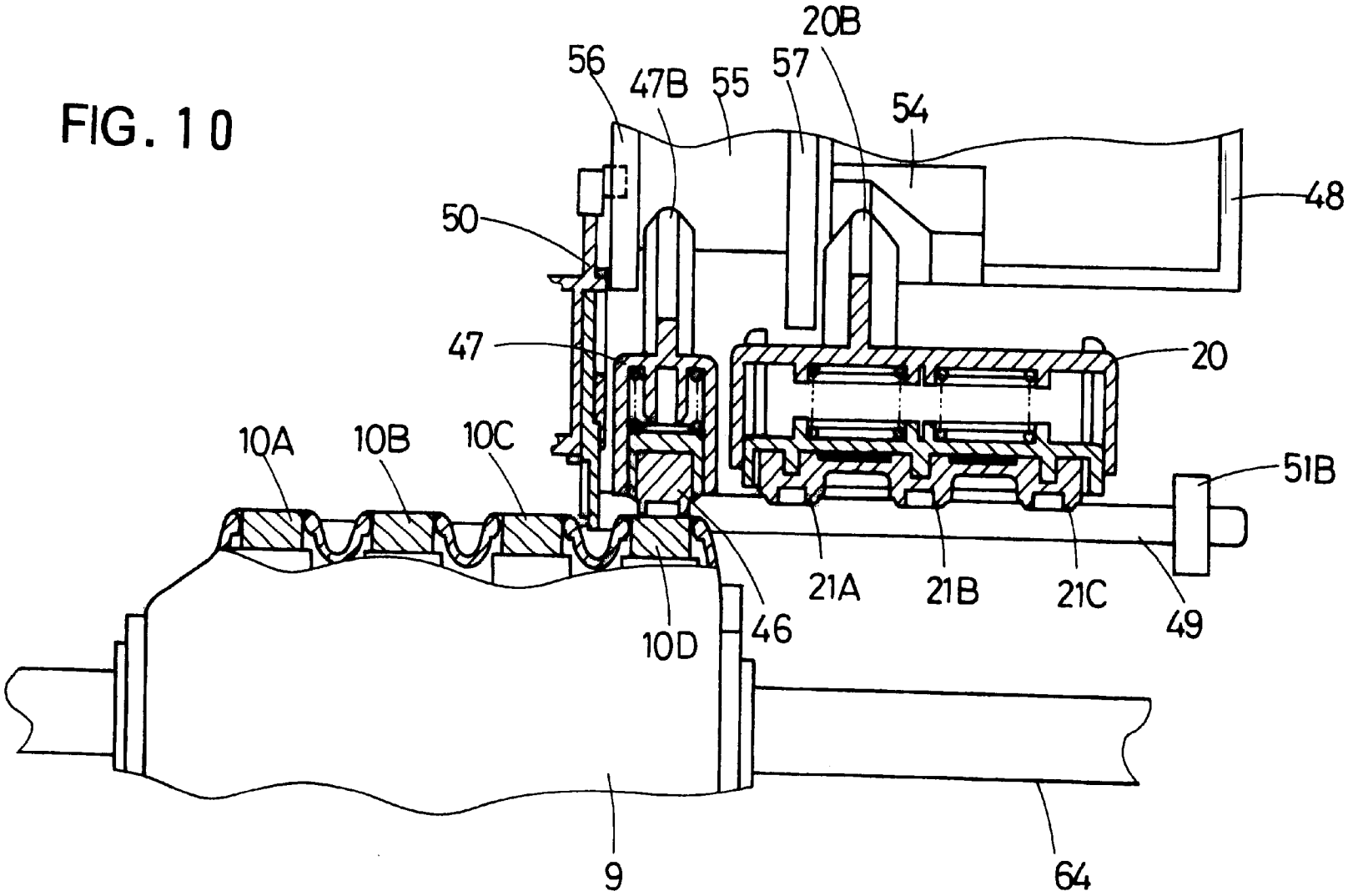
FIG. 10 is a plane sectional view showing a state where only the purge cap is advanced and covers the ink jet head (10D)
Figure 11:
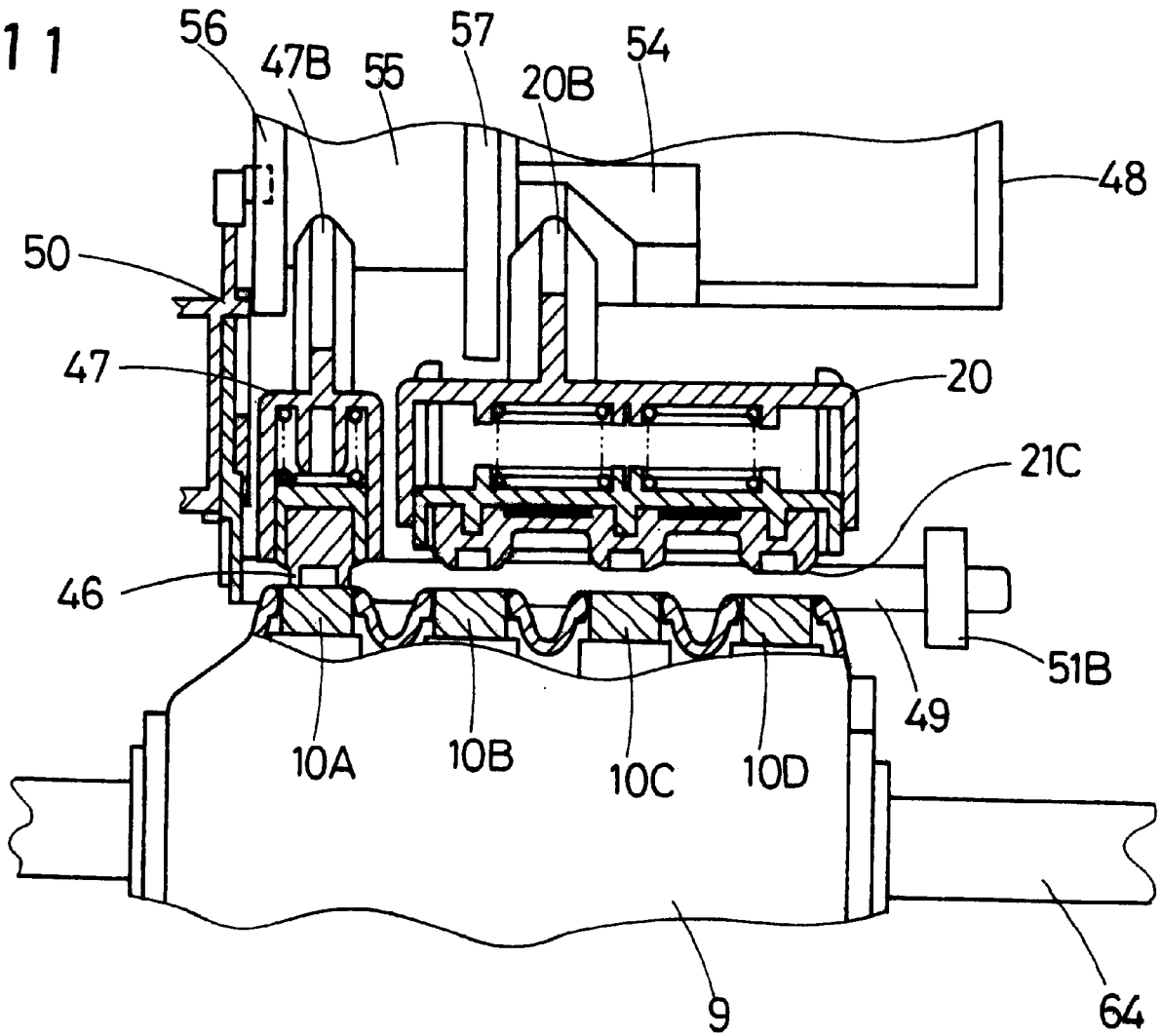
FIG. 11 is a plane sectional view showing a state where only the purge cap is advanced and covers the ink jet head (10A)

At this position, when the PF motor 72 is rotated to drive the cap cam 55 to advance the purge cap holder 47, the purge cap holder 47 alone is advanced straight against the biasing force of the return spring 52 (in a direction indicated by an arrow A in FIG. 3), without advancing the protecting cap case 20. Thus, only the head to be recovered is covered by the purge cap 46, as shown in FIG. 6, and other heads are not covered. This state is shown in FIGS. 10 and 11 which are plane sectional views, in which FIG. 10 is a state where the ink jet head 10D is covered by the purge cap 46 and FIG. 11 is a state where the ink jet head 10A is covered. It is of course possible to cover any of the ink jet heads 10B and 10C in a similar way.

With the further rotation of the PF motor 72 in the above state, the pump cam 57 drives the purge pump 44 thereby conducting ink suction as the head is covered by the purge cap 46. As a result, the deteriorated ink is removed from the ink jet head, recovering the ink ejection state thereof. The ink sucked is introduced through the hose 43 to the purge pump 44, and then discharged into the drain tank 48. After the completion of ink suction, the PF motor 72 is further rotated, thereby allowing the purge cap holder 47 to retract by a biasing force of the return spring 52, separating the purge cap 46 from the ink jet head as shown in FIG. 7.

Figure 8:
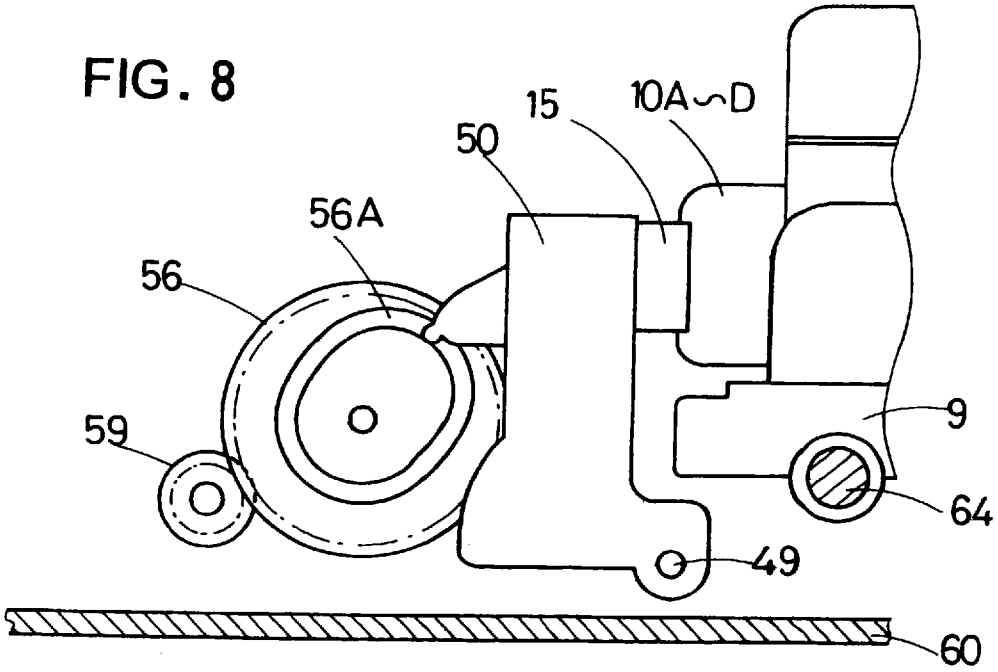
FIG. 8 is a side view showing a state where the wiper is advanced toward the nozzle faces.
Figure 9:
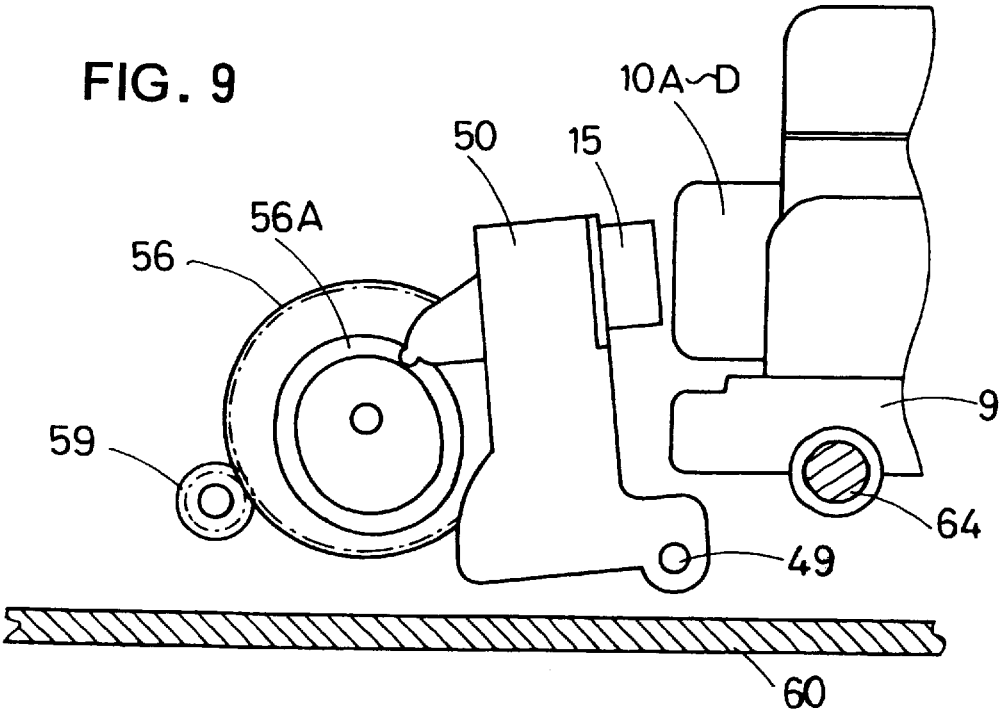
FIG. 9 is a side view showing a state where the wiper is retracted, separately from the nozzle faces.

Sequentially, with rotation of the wiper cam 56, the wiper 15 is advanced in a direction indicated by an arrow B in FIG. 3 and thus positioned as shown in FIG. 8, so that when the carriage 9 is moved toward the recording area after the recovery operation, the nozzle faces of the ink jet heads are wiped by the wiper 15 and made clean. After that, the wiper 15 is returned at a retracted position as shown in FIG. 9 and the gear train 74 is switched to connect with the platen roller 62 side. When the carriage 9 also returns to the recording area, the recording operation once stopped is conducted again. If two or more ink jet heads should be subjected to the recovery operation, returning to the recording operation is made after all recovery operations are performed on the ink jet heads respectively.

Meanwhile, during situations where the ink jet recording apparatus is utilized, there are instances whereby transmission of recording data from the host computer 81 are stopped for some time. During such a stop state, all nozzle faces of the ink jet heads 10A–D must be covered to prevent drying of ink, as well as when the power of the ink jet recording apparatus is turned off after the completion of using the apparatus. Accordingly, the CR motor 68 is driven to move the carriage 9 from the recording area through the recovery area to the protecting position, achieving protection of the nozzle faces. This protection will be explained below.

When the carriage 9 is moved from the recording area to the recovery area, the gear train 74 is switched to connect with the recovery system side as well as in the recovery operation, but driving of the cams is not conducted in particular in this state. The carriage 9 is further moved beyond the recovery area toward a more rightward direction than the position shown in FIG. 11. At this time, the carriage 9 is brought into contact with the hook 47A of the purge cap holder 47, so that the purge cap holder 47 pushed by the carriage 9 is then moved along the supporting shaft 49 against the biasing force of the return spring 52, simultaneously pushing the protecting cap case 20. The protecting cap case 20 is also moved along the supporting shaft 49 against the biasing force of the return spring 53.

When moved in a rightward direction of the drawing, the protecting cap case 20 is pushed forward, namely, toward the ink jet heads against the biasing force of the return spring 53 due to the inclination formed on the guide plate 54. With the forward movement of the protecting cap case 20, the hooker 20A pushes the hook 47A from the back thereof, moving the purge cap holder 47 forward against the biasing force of the spring 52. In this way, the purge cap holder 47 and the protecting cap case 20 are finally advanced obliquely in directions indicated by arrows C and D in FIG. 3 respectively, then covering the nozzle faces of the ink jet heads 10 by the protecting caps 21A–C and the purge cap 46. The movement of the carriage 9 is thus completed. This position is a protecting position.

The linear encoder arranged near the belt 70 transmits a signal to inform of the carriage 9 being at the protecting position to the CPU 83 of the control system, thereby forbidding the driving of the PF motor 72 after that.

Figure 12:
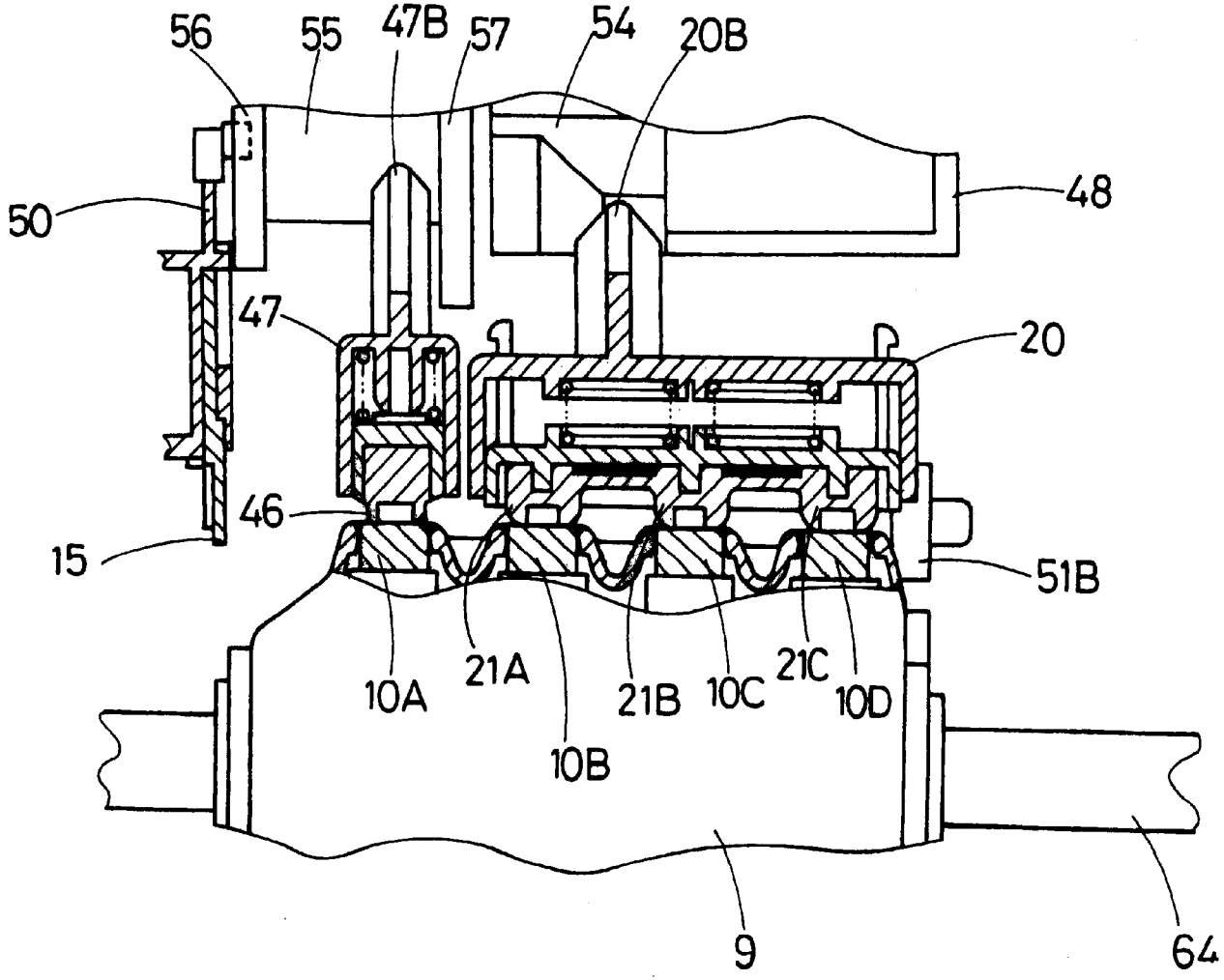
FIG. 12 is a plane sectional view showing a state where the purge cap and the protecting caps are obliquely moved toward and cover all of the ink jet heads.

The protecting state is illustrated in FIG. 12, showing a partial cross-sectional view seen from the top of the ink jet recording apparatus.

In this state, the nozzle face of the ink jet head 10A is covered by the purge cap 46 and those of the ink jet heads 10B–D are covered by the protecting caps 21A–C respectively, namely, all nozzle faces are covered, thereby to prevent drying of ink. This can avoid clogging in the nozzle faces resulted from solidification of ink accordingly. It should be noted that, comparing FIG. 12 with FIG. 11, the carriage 9 is moved in a more rightward direction.

The purge cap 46 is used for the recovery operation by the purge pump 44 and the protecting operation, serving as both a protecting and sucking cap. Using such the purge cap 46 makes it possible to reduce the number of the protecting caps 21A–C into three in the present embodiment, that is, less by one than the number of the ink jet heads 10A–D, being four.

When the ink jet head is returned from the stand-by state to an operation state, or when the switch is turned on to use the apparatus, the ink jet heads 10A–D must be released from the protecting state. The CR motor 68 is therefore driven to move the carriage 9 from the protecting position toward the recording area, removing the pushing force in a rightward direction in FIG. 12 of the carriage 9 on the hook 47A of the purge cap holder 47. The purge cap holder 47 is allowed to move leftward along the supporting shaft 49 by the biasing force of the return spring 52, together with that, the protecting cap case 20 is also moved by the biasing force of the return spring 53. Moved in the axis direction, the protecting cap case 20 is released from the pushed state by the inclination of the guide plate 54, and is retracted by a biasing force of the return spring 53. At the same time, released from the pushing by the hooker 20A, the purge cap holder 47A is retracted by the biasing force of the spring 52. The ink jet heads 10A–D are thus separated from the purge cap holder 47 and the protecting cap case 20.

When the carriage 9 leaves from the protecting position, the linear encoder attached on the belt 70 informs of it to the CPU 83 thereby to release the forbidding of activation of the PF motor 72. In the course of the movement of the carriage 9 from the recovery area to the recording area, the gear train 74 is switched to the platen roller 62 side, bringing the apparatus into a state where a recording operation can be performed. Prior to the movement to the recording area, the sucking operation by the purge pump 44 may be conducted by stopping the carriage 9 once at the recovery area.

As explained above, according to the present invention, the purge cap 46 is used for both the sucking operation and the protecting operation, and made to advance together with the protecting caps 21A–C in advancing, so that a compact ink jet recording apparatus can be realized with protecting caps in the same number as the inkjet heads. The guide plate 54 having an inclination is installed at the back of the protecting cap case 20, so that the protecting caps 21A–D can be advanced according to the movement of the carriage 9 from the recovery area to the protecting position, making the purge cap 46 advance at the same time, thereby covering all nozzle faces of the ink jet heads 10A–D, without installing a motor used only for the protecting operation.

Furthermore, the cap cam 55 is provided to advance only the purge cap 46 without advancing the protecting caps 21A–D when the carriage 9 is within the recovery area, making it possible to cover any ink jet head selected by the purge cap 46 and conduct a sucking operation on it by the purge pump 44.

The spring 53 is attached on the protecting cap case 20 and the spring 52 on the purge cap holder 47, biasing them in a retracting direction about the supporting shaft 49 and toward the wiper 15 in the axis direction of the supporting shaft 49. The caps are retracted by the biasing force of the return springs 53 and 52 respectively when the recording operation is conducted again from the stand-by state or when the recovery operation is completed, so that the movement of the carriage 9 will not be obstructed by the caps.

The wiper 15 is driven to move by the wiper cam 56 rotating integrally with the cap cam 55, relative to the movement of the purge cap 46, so that a wiping operation on the nozzle faces can be conducted by the wiper 15 after the sucking operation.

The ink recording apparatus according to the present invention is provided with the gear train 74 which can be switched in accordance with the movement of the carriage 9. With the movement of the carriage 9 from the recording area to the recovery area, accordingly, the PF motor 72 is separated from the platen roller 62, resulting in stoppage of the transporting of the recording sheet S, and connected with the recovery system, so that the purge cap 46, the wiper 15, and the purge pump 44 are brought into a workable state. On the other hand, the recovery systems are not activated when the carriage 9 is in the recording area.

As mentioned above, the linear encoder arranged near the belt 70 to drive the carriage 9 is used for a position sensor for detecting the position of the carriage 9. Based on the detection by the position sensor, the PF motor 72 is stopped from driving when the carriage 9 is at the protecting position. Accordingly, the platen roller 62 and the recovery system are not operated when the ink jet heads 10A–D are in the protecting state.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet recording apparatus comprising plural ink jet heads, each having a plurality of nozzles for ejecting ink on a recording medium, a carriage on which the ink jet heads are mounted, rendered movable as facing the recording medium, and a sucking mechanism for recovering an ink ejection state by sucking ink from the inside of the ink jet heads, the apparatus further comprising:

a first cap selectively covering the nozzles of one of the ink jet heads, the first cap being connected with the sucking mechanism and used for both a protecting operation of the nozzles of the one ink jet head and a sucking operation in cooperation with the sucking mechanism;

a plurality of second caps covering the nozzles of the ink jet heads except the nozzles of the one ink jet head covered by the first cap, the second caps being arranged adjacent to the first cap and used only for the protecting operation;

first means for advancing said second caps toward the nozzles of the ink jet heads when said carriage is moved to a protecting position, thereby covering the nozzles of the ink jet heads except the nozzles of the one ink jet head;

second means for advancing said first cap interlockingly with the advancing motion of the second caps, thereby covering the nozzles of the one ink jet head not covered with any of said second caps; and third means for advancing the first cap toward the nozzles of the one ink jet head independently from the second caps when the carriage is moved to a sucking position.

2. An ink jet recording apparatus according to claim 1, further comprising:

a cap case holding the second caps side by side, a cap holder holding the first cap in line with the second caps, and a supporting shaft rotatably and slidably supporting the cap case and the cap holder.

3. An ink jet recording apparatus according to claim 2, wherein the first means includes a back end portion protruded backward from the cap case and a guide plate with an inclined surface to which the back end portion is contacted, and wherein the second caps are advanced toward the ink jet heads by sliding and rotating the cap case along and around the supporting shaft while contacting the back end portion and the inclined surface, based on the carriage movement to the protecting position.

4. An ink jet recording apparatus according to claim 3, wherein the second means includes a hook protruded forward from the cap holder and a hooker formed forward from the cap case so as to engage into the hook, and wherein the first cap is advanced toward the ink jet head through interlocking operation of the hook and the hooker, based on the advancing movement of the second caps.

5. An ink jet recording apparatus according to claim 2, further comprising:

a first return spring biasing the cap case in a retracting direction, thereby retracting the second caps when the ink jet heads are not located at the protecting position; and a second return spring biasing the cap holder in a retracting direction, thereby retracting the first cap when the ink jet head is not located at the protecting position.

6. An ink jet recording apparatus according to claim 2, wherein the protecting position lies outside of a recording range by the ink jet heads.

7. An ink jet recording apparatus according to claim 6, further comprising:

means for transporting the recording medium;

a transporting motor driving the transporting means; and change mechanism selectively changing operation modes between first operation mode that the transporting motor is connected to the transporting means when the carriage exists in the recording range and second operation mode that the transporting motor is connected to the sucking mechanism when the carriage exists at the sucking position between the recording range and the protecting position.

8. An ink jet recording apparatus according to claim 7, wherein the third means independently advances and retracts said first cap by driving of said transporting motor when said carriage is at the sucking position.

9. An ink jet recording apparatus according to claim 8, wherein the third means includes first cam mechanism positioned between the cap holder holding the first cap and the transporting motor.

10. An ink jet recording apparatus according to claim 9, wherein the first cam mechanism comprises a back end portion protruded backward from the cap holder and a cap cam member rotated by the transporting motor, the back end portion being contacted to the cap cam member.

11. An ink jet recording apparatus according to claim 10, wherein the cap cam member has a non-circular cross-section.

12. An ink jet recording apparatus according to claim 8, further comprising:

a wiper member for wiping said ink jet heads; and fourth means for advancing and retracting the wiper member in relation to the advancing and retracting movement of the first cap by the third means.

13. An ink jet recording apparatus according to claim 12, wherein the fourth means includes second cam mechanism positioned between the wiper member and the transporting motor.

14. An ink jet recording apparatus according to claim 13, wherein the second cam mechanism comprises a wiper arm having one end and a second end, at the one end of which the wiper member is fixed, the wiper arm being rotatably supported to the supporting shaft, and a wiper cam member rotated by the transporting motor, the second end of the wiper arm being engaged thereto.

15. An ink jet recording apparatus according to claim 7, further comprising fifth means for preventing driving of the transporting motor when said carriage is at the protecting position.

16. An ink jet recording apparatus according to claim 15, further comprising sixth means for releasing the fifth means when the carriage leaves from the protecting position.

* * * * *